US006363235B1

(12) United States Patent
Chiesa et al.

(10) Patent No.: US 6,363,235 B1
(45) Date of Patent: Mar. 26, 2002

(54) TONER BOTTLE/CARTRIDGE HOUSING ATTACHMENT ASSEMBLY

(75) Inventors: Daniel A. Chiesa, Webster, NY (US); Thomas W. Claessens, Venray (NL); Karl E. Kurz; John Howard, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/773,070

(22) Filed: Jan. 31, 2001

(51) Int. Cl.[7] ..... G03G 15/08; B65B 1/04
(52) U.S. Cl. ..... 399/258; 141/346; 399/260
(58) Field of Search ..... 399/106, 120, 399/252, 258, 260, 262; 141/256, 346, 364; 222/DIG. 1, 160, 164, 166, 325

(56) References Cited

U.S. PATENT DOCUMENTS 4,752,807 A * 6/1988 Mort ..... 399/106
5,710,963 A * 1/1998 Dirx ..... 399/262
5,970,284 A * 10/1999 Garcia et al. ..... 399/120
6,134,411 A * 10/2000 Meyer et al. ..... 399/262
6,269,234 B1 * 7/2001 Kurz et al. ..... 399/258

* cited by examiner

*Primary Examiner*—Susan S. Y. Lee
*Assistant Examiner*—Hoan Tran
(74) *Attorney, Agent, or Firm*—Perman & Green, LLP

(57) ABSTRACT

A toner-dispensing container assembly for attachment to a toner compartment cover device on an electrographic printing machine to supply toner composition to the toner receiving compartment while avoiding detachment and spillage. The toner-dispensing container assembly is fastenable over the toner compartment cover device and rotatable to a first position to open the cover to the toner compartment while the toner-dispensing container remains sealed. Further rotation of the toner dispensing container opens it to the toner-receiving compartment to dispense toner thereinto.

6 Claims, 3 Drawing Sheets

TONER BOTTLE/CARTRIDGE HOUSING ATTACHMENT ASSEMBLY

BACKGROUND OF THE INVENTION

1. Field of the Invention

The present invention relates to electrophotographic copying machines which employ and consume xerographic toner powders or developers for the development of electrostatic images during the production of copies of imaged originals.

More particularly, the present invention relates to improved assemblies for the attachment and periodic replacement of filled toner containers to the housing of a toner cartridge comprising a compartment from which toner is metered to the image-development station of an electrophotographic copying machine.

2. State of the Art

In known electrophotographic machines having refillable toner cartridges designed to be refilled or replenished by the user pouring toner thereinto from a toner container, there is substantial risk of toner spillage and waste, and of contamination of the machine, the work environment and the user.

Reference is made to U.S. Pat. No. 5,383,502 for its disclosure of a toner-supply container having a lid which is automatically opened to dispense toner into a toner-metering compartment of a copying machine when the toner container lid is moved into engagement with an unlatching mechanism, providing clean and automatic toner replenishment.

Reference is also made to U.S. Pat. Nos. 5,797,073 and 5,852,760 which disclose motor-driven toner containers for metering toner particles to the developer unit of an electrophotographic copying machine. Both of these patents disclose rotatable toner-supply containers which interlock with the toner storage unit of the machine and have an aperture from which toner is metered with each horizontal rotation of the supply containers.

The toner-supply containers of U.S. Pat. No. 5,797,073 incorporate a sealing means for the toner-release aperture, which sealing means is normally biased to seal the aperture when the container is separated from the apparatus, to prevent spillage of the toner before and during the connection of the toner supply container to the apparatus. Rotation of the container, during operation of the copy apparatus, causes the sealing means to be opened to permit metering of the toner composition into the toner storage compartment.

It is desirable to avoid the need for rotating the toner-supply container and therefore the modern electrostatographic machines incorporate vertically-supported toner-supply containers which feed toner composition into the toner-storage compartment of the apparatus by gravity flow. It is also necessary to preclude the premature release or spillage of the toner composition from such containers during attachment and/or detachment of the containers in vertical orientation from the apparatus.

SUMMARY OF THE INVENTION

The present invention relates to an assembly of a cover means for a toner-supply container and a mating cover means for a toner-receiving compartment of an electrostatographic copy machine. More particularly the invention relates to an assembly in which the cover means for the toner-supply container cannot be independently opened manually, thereby precluding spillage, and cannot be opened in assembly until fully engaged with the mating cover means of the toner-receiving compartment. The present assemblies preclude tilting of the supply container and spillage of the toner composition during attachment and detachment of the toner-supply container by maintaining the supply container sealed until after the assembly is engaged and rotated to a first tilt-preventing position, to open the cover to the toner-receiving compartment, after which the supply container must be rotated to a final dispensing position to open it to the toner-receiving compartment.

DETAILED DESCRIPTION OF THE PREFERRED EMBODIMENT

Figure 1:
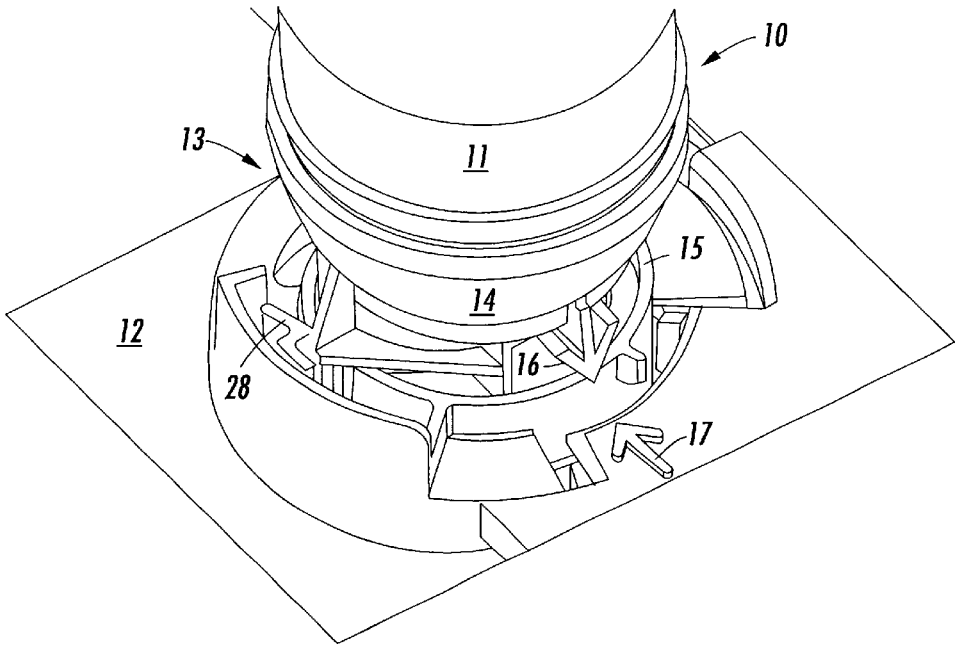
FIG. 1 is a perspective view of a pre-assembly of a toner-supply container and a toner cartridge comprising the toner-receiving compartment of an electrostatographic apparatus at initial alignment for attachment.

Referring to FIG. 1 of the drawings, the toner supply container assembly 10 comprises a bottle section 11 adapted to contain a supply of particulate toner composition to be gravity-fed to the toner-receiving compartment of an electrostatographic copying machine 12. The supply container is normally-closed or sealed by a closure means comprising an inner sleeve section 14 fastened around the lower portion of the bottle section 11 and an outer retainer ring sleeve section 15 which is rotatable with, but releasably-attached to, the inner cap section 14 to permit the bottle and inner cap section 14 to be rotated into open position, relative to the outer cover ring section 15, only after the toner supply container 10 is assembled with the toner-receiving compartment of the machine 12 and the outer sleeve section 15 has been rotated to open the cover of the toner-receiving compartment, and after the attachment between the sections 14 and 15 is released to permit relative rotation therebetween to open the cover of the toner-containing bottle 11.

The objectives of the present invention are to provide a toner-supply bottle assembly having (a) a sealing cover means which cannot be manually opened apart from an unlatching means present on the mating cover means on the toner-receiving compartment, and having (b) a locking means which is integrated with the mating cover means of the toner-receiving compartment to prevent tilting of the bottle assembly before it is fully in place, and (c) having a means for first rotating to open the inlet door of the toner-receiving compartment or cartridge and subsequently rotating to open the outlet door of the toner supply bottle into alignment with the open toner-receiving compartment to permit gravity flow of the toner composition.

Figure 2:
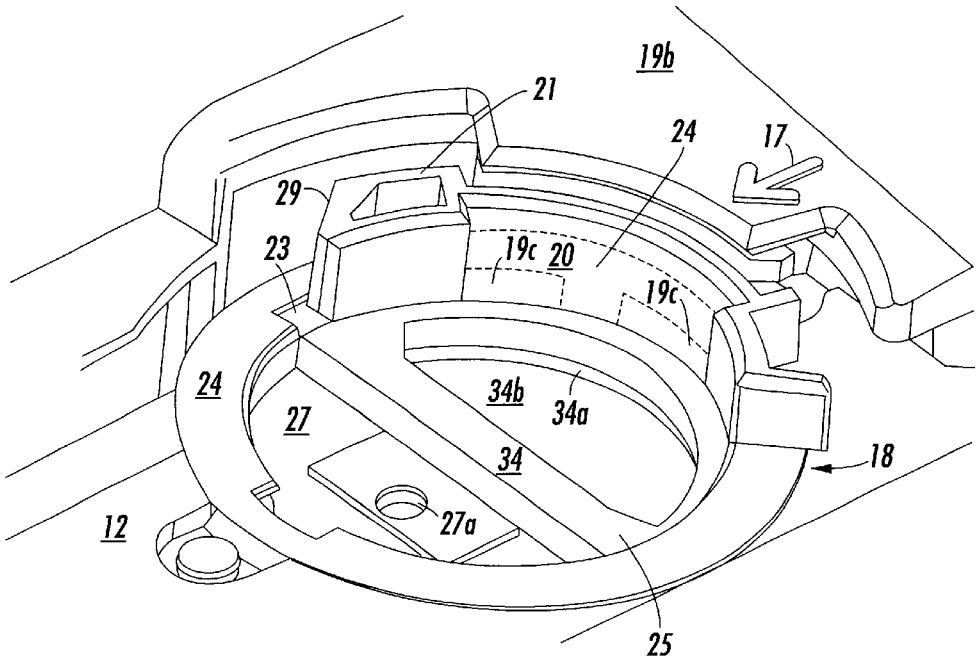
FIG. 2 is a perspective view of the mating 180°-rotatable cover means of the toner-receiving compartment of the pre-assembly of FIG. 1 in closed position prior to attachment of the toner-supply container.
Figure 3:
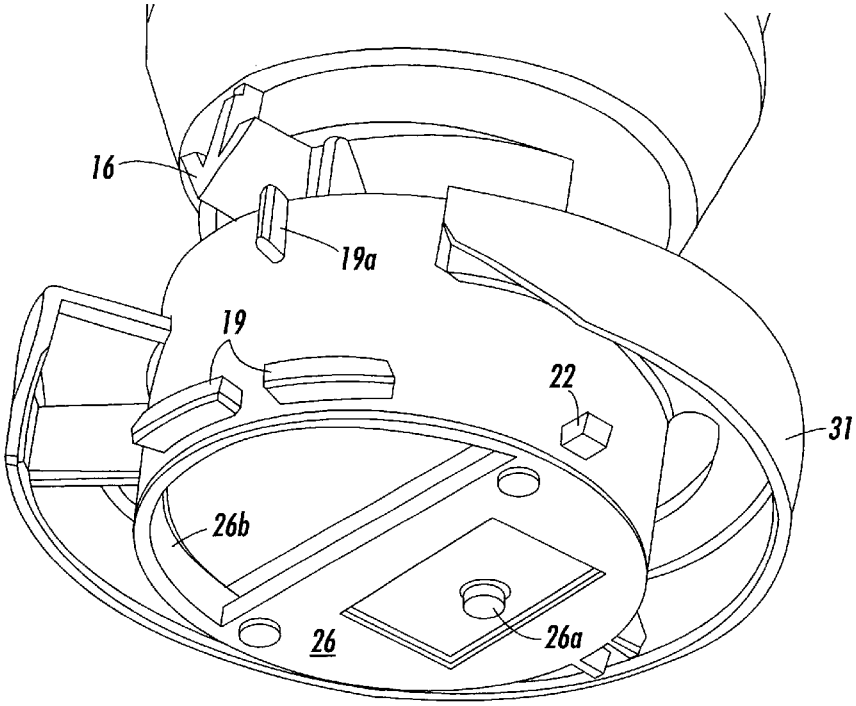
FIG. 3 is a perspective view of the underside of the toner supply container assembly of the present invention, viewed from the front and with the cover dispensing door in closed position.

As illustrated in FIG. 1, the toner supply container assembly 10 is provided with indicia means, such as arrow 16, and the housing of the toner-receiving compartment 12 is provided with a similar indicia means 17, adjacent the cover means 18 of the toner-receiving compartment 12 to facilitate alignment of the toner bottle assembly 10 and the toner-receiving compartment 12 for attachment and detachment therebetween. Attachment involves a first step of pushing down on bottle assembly 10 to position the outer lower ring wall projections 19 of assembly 10, shown in FIG. 3, within the recess 20 of the latch-release wall 21 to compress the foam sealing section 34 of the toner-compartment cover means 18, shown in FIG. 2, and simultaneously pressing the undersurface of the upper anti-tilt ring wall projection 19*a* down against the upper wall surface 19*b* of the toner compartment housing, shown in FIG. 2. Also, the anti-tilt projection 22 of the outer ring 15 is depressed down into the opening 23 and the projections 19 are depressed down into openings 19C of the annular floor 24 surrounding the rotatable cover/sealing disk 25 of the cover means 18. In such depressed position, the undersurface 26 of the outer ring member 15 and its projection 26*a* mates with the upper surface 27 and its slot 27*a* of the cover means 18, and clockwise rotation of the bottle assembly 10 180° locks the anti-tilt projection 19*a* against the upper surface 19*b* of the housing and also locks the anti-tilt projection 22 and alignment projections 19 for rotation beneath annular floor 24 and causes a tapered surface of the flexible latch mechanism 28 to be moved into engagement with the outwardly-tapered latch deflection surface 29 of the latch release wall 21, thereby deflecting the latch mechanism radially-outwardly. The cover means 25 is provided with a stop means which limits its rotation to 180°.

Figure 4:
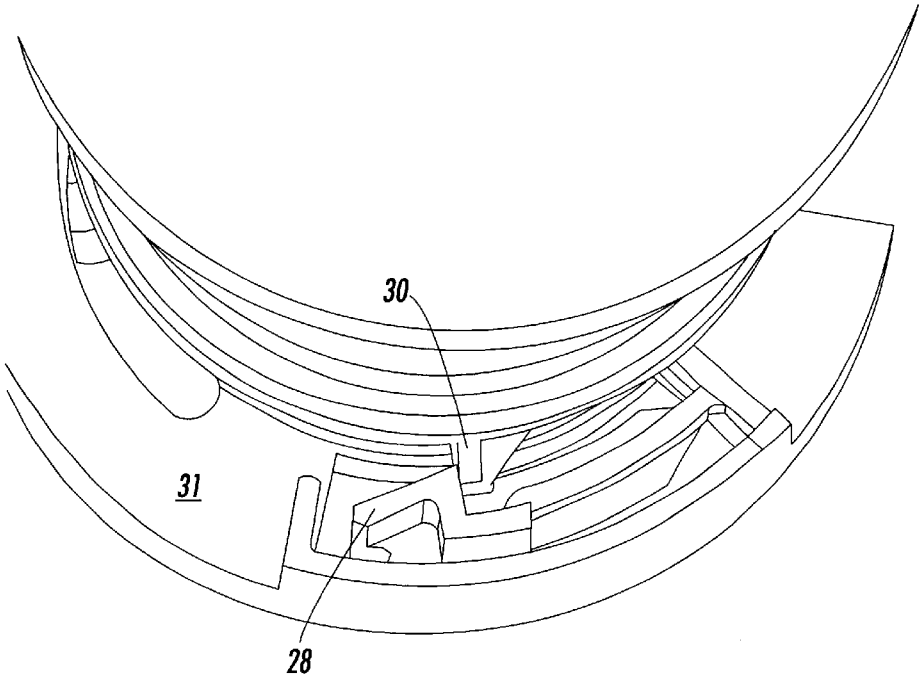
FIG. 4 is a perspective view of the upper surface of the assembly of FIG. 3, viewed from the rear.

As illustrated by FIG. 4, the latch mechanism 28, mounted on the outer ring member 15 of the bottle assembly 10, serves as a stop member which normally prevents rotation of the bottle assembly relative to the outer ring member 15 by engaging a vertical stop rib 30 which projects from the surface of the inner ring member 14 on the bottle 11. This prevents relative rotation between the ring members 14 and 15 and inadvertent opening of the bottle 11 until the latch mechanism is released, and inadvertent release of the latch mechanism 28 is further precluded by the location of the latch mechanism beneath or inside the wall of the peripheral collar 31.

The outward deflection of the flexible latch mechanism 28, caused by 180° rotation of the bottle assembly 10, with ring members 14 and 15, into engagement with deflection surface 29, frees the bottle 11 and inner ring 14 to rotate within the outer ring 15 which is locked in position. The first 180° rotation of the assembly 10 opens the toner-receiving compartment of the cartridge 12 by rotating the cover/sealing disk 25 until opening 34*a* in section 34 is in the position formerly occupied by floor section 27. In this 180° rotation position the cover opening 34*a* is moved from a sealed position, in which it overlies a closed portion 34*b* of the compartment 12, to an open position in which it overlies an opening in the compartment 12, formerly sealed by floor section 27 of the cover/sealing disk 25. A stop member on the housing 12 limits rotation of disk 25 to 180° in each direction. The second 180° rotation, of the unlocked toner bottle 11 and inner ring 14, opens the mouth of the bottle 11 by positioning compartment 33 in the inner ring member 14 over opening 26*b* in ring member 15, aligned with opening 34*a* in the 180°-rotated cover/sealing disk 25, to permit gravity flow of the toner composition to fill the cartridge compartment within housing 12. This procedure assures that the bottle assembly 10 is locked onto the mating cover means of the toner-receiving compartment on housing 12 in a tilt-resistant engagement before the toner-receiving compartment cover/sealing disk 25 is rotated to open position, with the first 180° rotation of the assembly 10, and that the toner bottle remains closed until the bottle is unlatched from the outer ring 15 and rotated another 180°.

Figure 5:
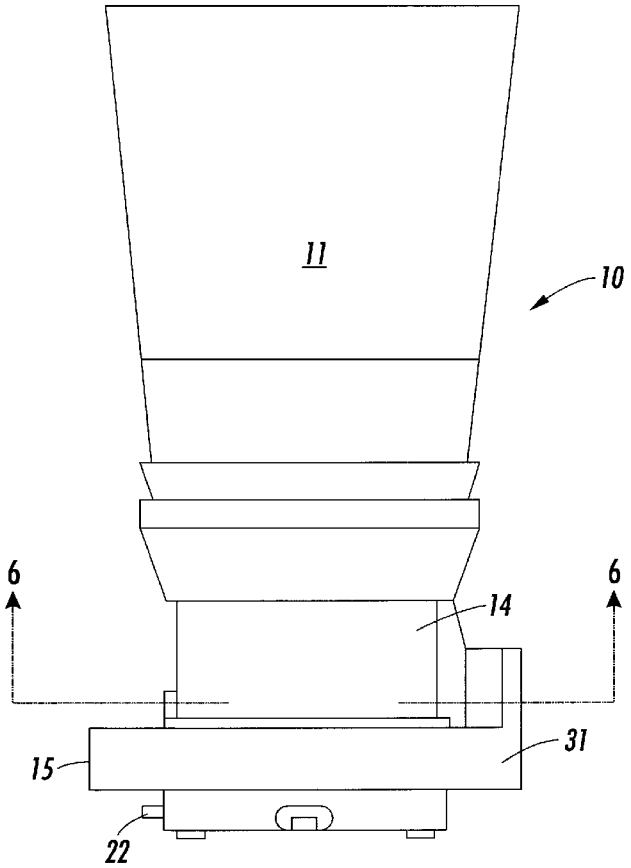
FIG. 5 is a side view of the toner bottle and cover assembly of FIG. 3.
Figure 6:
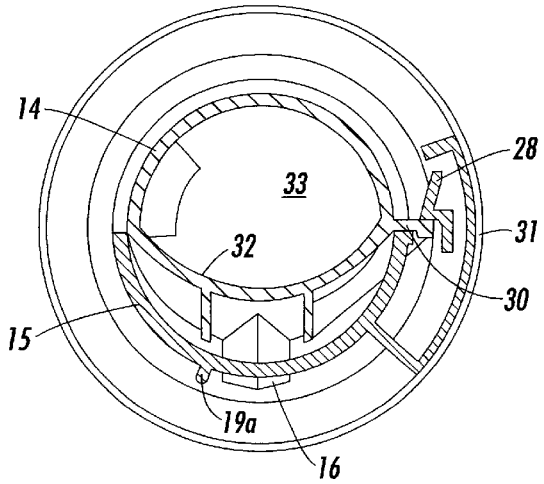
FIG. 6 is a cross-section taken along the line 6—6 of FIG. 5.

FIGS. 5 and 6 further illustrate the assembly 10 comprising the bottle 11, inner ring member 14 and outer ring member 15 in initial closed position. In the cross-sectional view of FIG. 6, the inner ring member 14 is illustrated to have a partition wall 32 which forms a funnel compartment 33 which communicates with the mouth of the toner-supply bottle 11 and with the opening 34*a* in the foam section 34 of the cover/sealing disk 25 when it is open to the toner-receiving compartment 12 but otherwise is sealed by floor section 26 of the outer ring section 15.

The rotation procedure is reversed to close the bottle compartment 33 by rotating the bottle 11 and its ring section 14 by 180° until the mouth of compartment 33 overlies and is sealed by the floor portion 26 of the outer ring 15. A further 180° rotation causes the rib 30 to pass over the tapered deflection surface 29 and deflect the latch mechanism 28 and become locked therebeyond so as to re-lock the bottle 11 and its ring section 14 to the outer ring section 15. The relocked unit can then be disengaged from the cover/sealing disk 25 of the toner compartment and refilled for reuse.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A toner container/toner compartment cover assembly for removably attaching a toner-dispensing container to a toner-receiving compartment while avoiding spillage of toner, said assembly comprising:

(a) a toner-dispensing container assembly comprising an elongate toner-containing bottle having a dispensing mouth at the lower end thereof;

(b) an inner ring collar member secured to said bottle and extending around the lower end thereof;

(c) an outer ring collar member rotatably secured to and surrounding said inner ring collar member and having a floor section which covers and seals the dispensing mouth of the toner-containing bottle when the outer ring collar member is oriented in a first position relative to the inner ring collar member and which uncovers said dispensing mouth when the inner ring collar member is rotated to a second position relative to the outer ring collar member;

(d) a releasable latching means on said outer ring collar member which engages a stop member on said inner ring collar member which normally prevents the outer ring collar member from being rotated between said first and second positions relative to the inner ring collar member;

(e) a toner compartment cover member attachable over an opening of a toner-receiving compartment, said cover member comprising a peripheral rim member rotatably supporting a sealing disk between a first position in which it seals the toner-receiving compartment and a second position in which it uncovers the opening of the toner-receiving compartment, said peripheral rim member containing means for rotatably attaching the outer ring collar member of the toner-dispensing container assembly thereto, with the floor section thereof in engagement with the sealing disk of the cover member for rotation and opening of the toner-receiving compartment, and (f) unlatching means associated with said toner compartment cover member for engaging and releasing the latching means present on said outer ring collar member when the attached toner-dispensing container assembly is rotated over said cover member to rotate the sealing disk of the cover member into its second position to open the toner-receiving compartment, the release of the latching means enabling said toner-containing bottle and attached inner ring collar member to be further rotated into said second position, relative to said outer ring collar member, to open the dispensing mouth of the toner-containing bottle to the open toner-receiving compartment.

2. An assembly according to claim 1 in which said outer ring collar member contains radial projections which mate with openings in the peripheral rim of the toner compartment cover member and are rotatable under the rim to secure the toner-dispensing container assembly against tipping or release.

3. An assembly according to claim 1 in which the unlatching means associated with the toner compartment cover member comprises a wall member extending above said outer ring collar member and having an outwardly-tapered surface which engages a mating tapered surface of the latching means on the outer ring collar member, to stop rotation of the latter and to urge the latching means radially-outwardly beyond the stop member present of the inner ring collar member and permit further rotation of the inner ring collar member relative to the outer ring collar member.

4. An electrophotographic copying machine comprising a toner container/toner compartment cover assembly for removably attaching a toner-dispensing container to a toner-receiving compartment of said copying machine while avoiding spillage of toner, said copying machine comprising:

(a) a toner-dispensing container assembly comprising an elongate toner-containing bottle having a dispensing mouth at the lower end thereof;

(b) an inner ring collar member secured to said bottle and extending around the lower end thereof;

(c) an outer ring collar member rotatably secured to and surrounding said inner ring collar member and having a floor section which covers and seals the dispensing mouth of the toner-containing bottle when the outer ring collar member is oriented in a first position relative to the inner ring collar member and which uncovers said dispensing mouth when the inner ring collar member is rotated to a second position relative to the outer ring collar member;

(d) a releasable latching means on said outer ring collar member which engages a stop member on said inner ring collar member which normally prevents the outer ring collar member from being rotated between said first and second positions relative to the inner ring collar member;

(e) a toner compartment cover member attachable over an opening of a toner-receiving compartment on the copying machine, said cover member comprising a peripheral rim member rotatably supporting a sealing disk between a first position in which it seals the toner-receiving compartment and a second position in which it uncovers the opening of the toner-receiving compartment, said peripheral rim member containing means for rotatably attaching the outer ring collar member of the toner-dispensing container assembly thereto, with the floor section thereof in engagement with the sealing disk of the cover member for rotation and opening of the toner-receiving compartment, and (f) unlatching means associated with said toner compartment cover member for engaging and releasing the latching means present on said outer ring collar member when the attached toner-dispensing container assembly is rotated over said cover member to rotate the sealing disk of the cover member into its second position to open the toner-receiving compartment, the release of the latching means enabling said toner-containing bottle and attached inner ring collar member to be further rotated into said second position, relative to said outer ring collar member, to open the dispensing mouth of the toner-containing bottle to the open toner-receiving compartment.

5. An electrophotographic copying machine according to claim 4 in which said outer ring collar member of the cover assembly contains radial projections which mate with openings in the peripheral rim member of the toner compartment cover member and are rotatable under the rim to secure the toner-dispensing container assembly to the toner-receiving compartment of the copying machine against tipping or release.

6. An electrophotographic copying machine according to claim 4 in which the unlatching means associated with the cover member of the toner-receiving compartment comprises a wall member extending above said cover member and having an outwardly-tapered surface which engages a mating tapered surface of the latching means on the outer ring collar member, to stop rotation of the latter and to urge the latching means radially-outwardly beyond the stop member present of the inner ring collar member and permit further rotation of the inner ring collar member relative to the outer ring collar member to open the dispensing mouth of the toner-containing bottle to the open toner-receiving compartment of the copying machine.

* * * * *